US011643934B2

(12) United States Patent
Krueckels et al.

(10) Patent No.: US 11,643,934 B2
(45) Date of Patent: May 9, 2023

(54) TRAILING EDGE TIP COOLING OF BLADE OF A GAS TURBINE BLADE

(71) Applicant: DOOSAN ENERBILITY CO., LTD, Changwon-si (KR)

(72) Inventors: Joerg Krueckels, Baden (CH); Herbert Brandl, Baden (CH); Ulrich Rathmann, Baden (CH); Willy H Hofmann, Baden (CH)

(73) Assignee: DOOSAN ENERBNLITY CO., LTD., Changwon (KR)

( * ) Notice: Subject to any disclaimer, the term of this patent is extended or adjusted under 35 U.S.C. 154(b) by 0 days.

(21) Appl. No.: 17/517,653

(22) Filed: Nov. 2, 2021

(65) Prior Publication Data

US 2022/0170374 A1 Jun. 2, 2022

(30) Foreign Application Priority Data

Nov. 13, 2020 (EP) ..... 20207341

(51) Int. Cl.
*F01D 5/18* (2006.01)
*F01D 5/20* (2006.01)

(52) U.S. Cl.
CPC ..... *F01D 5/185* (2013.01); *F01D 5/187* (2013.01); *F01D 5/20* (2013.01); *F05D 2220/32* (2013.01); *F05D 2240/304* (2013.01); *F05D 2240/307* (2013.01)

(58) Field of Classification Search
CPC . F01D 5/186; F01D 5/187; F01D 5/20; F05D 2240/304; F05D 2240/307; F05D 2260/20; F05D 2260/202
See application file for complete search history.

(56) References Cited

U.S. PATENT DOCUMENTS

2003/0223870 A1 12/2003 Keith
2004/0151586 A1* 8/2004 Chlus ..... F01D 5/187 416/97 R
2014/0047842 A1* 2/2014 Chlus ..... F01D 5/20 60/726
2018/0223675 A1* 8/2018 Roberts ..... F01D 5/20
2018/0347374 A1 12/2018 Beyer
2019/0368359 A1 12/2019 Quach

OTHER PUBLICATIONS

English machine translation of WO 2021/019156A1, Oct. 5, 2022.*
European Patent Office Search Report dated Feb. 19, 2021.
The European Office Action, dated Dec. 2, 2022.

* cited by examiner

*Primary Examiner* — Christopher Verdier
(74) *Attorney, Agent, or Firm* — Harvest IP Law LLP

(57) ABSTRACT

A turbine blade is provided. The turbine blade may include an airfoil having an airfoil tip, a leading edge, a trailing edge, and a pressure side and a suction side extending from the leading edge to the trailing edge and defining an airfoil cavity, a squealer tip arranged at the airfoil tip part and comprising a trailing edge tip portion disposed at the trailing edge of the airfoil and a pressure side rail and a suction side rail meeting at the trailing edge tip portion and defining a squealer tip pocket at the airfoil tip, and at least one tip cooling hole disposed at the squealer tip pocket to provide cooling air from the airfoil cavity to the squealer tip pocket, wherein the trailing edge tip portion of the squealer tip includes a chamfer disposed towards the pressure side of the airfoil and a groove extending from the squealer tip pocket to the chamfer to provide cooling air from the squealer tip pocket to the chamfer.

18 Claims, 10 Drawing Sheets

TRAILING EDGE TIP COOLING OF BLADE OF A GAS TURBINE BLADE

CROSS-REFERENCE TO RELATED APPLICATION

This application claims priority to European Patent Application No. 20 207 341.7, filed on Nov. 13, 2020, the disclosure of which is incorporated herein by reference in its entirety.

FIELD

Apparatuses and methods consistent with exemplary embodiments relate to gas turbines, and more particularly, to techniques for cooling a trailing edge tip of a gas turbine blade.

BACKGROUND

A gas turbine is a power engine that mixes air compressed by a compressor with fuel for combustion and rotates a turbine with high-temperature gas produced by the combustion. The gas turbine is used to drive a generator, an aircraft, a ship, a train, and so forth.

Referring to FIGS. 4 and 7, a related art gas turbine blade 1' include an airfoil 100 extending radially outward from a blade platform with respect to a rotational axis of the gas turbine. The airfoil 100 includes a leading edge 106 and a trailing edge 108, a pressure side 102 and a suction side 1004 each of which extends from the leading edge 106 and trailing edge 108, and an airfoil tip 100*a* disposed at radially outer end of the airfoil 100. The airfoil tip 100*a* faces a surface of a stator disposed radially more outward of the airfoil 100 and defining an outer surface of high temperature combustion gas path through the gas turbine. The surface of the stator toward which the airfoil tip 100*a* faces may be an inner surface of a casing or an inner surface of a turbine shroud.

The airfoil tip 100*a* is spaced apart from the opposing stator surface (i.e., in a non-contact manner). In other words, a radial clearance or gap is included between the airfoil tip 100*a* of the airfoil 100 and the opposing stator surface to avoid collision or friction between the airfoil tip 100*a* of the airfoil 100 and the opposing stator surface when the gas turbine is operated. However, a portion of the hot gas flowing through the hot gas path (i.e., combustion products) does not flow over the turbine blade airfoil 100 but leaks through the radial clearance, reducing efficiency.

Therefore, it is desirable that the radial clearance between the airfoil tip 100*a* of the airfoil 100 and the opposing stator surface be kept as small as possible to minimize leakage of hot gas.

To keep the radial clearance small, and to protect the airfoil body from structural damage in case of accidental contact between the airfoil tip 100*a* of the airfoil 100 and the opposing stator surface during operation of the gas turbine, it is well known in the art of gas turbines to employ a squealer tip structure 60' disposed at the airfoil tip 100*a* of the airfoil 100 and extending radially outwardly towards the opposing stator surface.

The squealer tip 60' has a shape of a rail and is positioned at and extending along a periphery of the airfoil tip 100*a*. For example, the squealer tip 60' may have a suction side rail 64' positioned at and extending along a periphery of the suction side 104 at the airfoil tip 100*a* and a pressure side rail 62' positioned at and extending along a periphery of the pressure side 102 at the airfoil tip 100*a*. The suction side rail 64' and the pressure side rail 62' of the squealer tip 60' meet at a trailing edge tip portion 70' of the squealer tip 60'.

Because the squealer tip 60' is immersed in hot combustion products (i.e., the hot gas), cooling of the squealer tip 60' is particularly required at the trailing edge tip portion 70'. For example, cooling holes 102*h'* are disposed on side surfaces of the airfoil 100, i.e., at the pressure side 102 and/or the suction side 104 of the airfoil 100, in the vicinity of the trailing edge tip portion 70'. However, the related art cooling technique does not provide efficient cooling of the trailing edge tip portion 70' of the squealer tip 60' of the blade 1'.

SUMMARY

Aspects of one or more exemplary embodiments provide a turbine blade for effectively cooling the trailing edge tip portion of the squealer tip of a gas turbine blade.

Additional aspects will be set forth in part in the description which follows and, in part, will become apparent from the description, or may be learned by practice of the exemplary embodiments.

According to an aspect of an exemplary embodiment, there is provided a turbine blade including: an airfoil having an airfoil tip, a leading edge, a trailing edge, and a pressure side and a suction side extending from the leading edge to the trailing edge and defining an airfoil cavity therein; a squealer tip arranged at the airfoil tip and including a trailing edge tip portion disposed at the trailing edge of the airfoil and a pressure side rail and a suction side rail meeting at the trailing edge tip portion and defining a squealer tip pocket at the airfoil tip; and at least one tip cooling hole disposed at the squealer tip pocket to provide cooling air from the airfoil cavity to the squealer tip pocket. The trailing edge tip portion of the squealer tip may include a chamfer disposed towards the pressure side of the airfoil and a groove extending from the squealer tip pocket to the chamfer to provide cooling air from the squealer tip pocket to the chamfer.

The groove and the chamfer may extend in a longitudinal direction along a camber line of the airfoil.

The chamfer may have a concave shape at the groove-side of the chamfer. The chamfer may have a planar or convex shape at a trailing-edge-side of the chamfer.

A shape of the chamfer may be formed by gradually transitioning from a concave shape at the groove-side of the chamfer to a planar or convex shape at the trailing-edge-side of the chamfer.

The trailing edge tip portion may include at least one chamfer-cooling hole disposed at the chamfer to provide cooling air from the airfoil cavity to the chamfer.

The trailing edge tip portion may include a plurality of chamfer-cooling holes spaced apart from each other at regular intervals.

An outlet of the groove may be spaced apart from the chamfer along a radially outward direction of the airfoil.

The at least one tip cooling hole may include a first tip cooling hole disposed adjacent to the inlet of the groove.

A length of the chamfer may be greater than or equal to 0.01 times a chord length of the airfoil and less than or equal to 0.2 times the chord length of the airfoil. Preferably, the length of the chamfer may be greater than or equal to 0.02 times the chord length of the airfoil and less than or equal to 0.15 times the chord length of the airfoil.

The chamfer may be defined between a first position of the trailing edge tip portion corresponding to the trailing edge of the airfoil and a second position of the trailing edge tip portion corresponding to a distance equal to or less than 0.2 times the chord length of the airfoil from the first position measured along a chord of the airfoil.

A width of the groove may decrease along a radially inward direction of the airfoil. A floor of the groove may be inclined downward towards the pressure side of the airfoil.

A length of the groove may be greater than or equal to 0.01 times a chord length of the airfoil and less than or equal to 0.20 times the chord length of the airfoil. Preferably, the length of the groove may be greater than or equal to 0.02 times the chord length of the airfoil and less than or equal to 0.15 times the chord length of the airfoil.

A length of the groove may be smaller than a length of the chamfer.

According to an aspect of another exemplary embodiment, there is provided a turbine blade assembly including: a rotor disk configured to be rotatable and a plurality of turbine blades installed on the rotor disk. Each of the turbine blade may include: an airfoil having an airfoil tip, a leading edge, a trailing edge, and a pressure side and a suction side extending from the leading edge to the trailing edge and defining an airfoil cavity therein; a squealer tip arranged at the airfoil tip and comprising a trailing edge tip portion disposed at the trailing edge of the airfoil and a pressure side rail and a suction side rail meeting at the trailing edge tip portion and defining a squealer tip pocket at the airfoil tip; and at least one tip cooling hole disposed at the squealer tip pocket to provide cooling air from the airfoil cavity to the squealer tip pocket, wherein the trailing edge tip portion of the squealer tip may include: a chamfer disposed towards the pressure side of the airfoil; and a groove extending from the squealer tip pocket to the chamfer to provide cooling air from the squealer tip pocket to the chamfer.

According to an aspect of another exemplary embodiment, there is provided a gas turbine including: a compressor configured to compress air introduced thereinto from an outside; a combustor configured to mix fuel with air compressed by the compressor for combustion; and a turbine including a plurality of turbine blades rotated by combustion gas produced by the combustor. Each of the turbine blade may include: an airfoil having an airfoil tip, a leading edge, a trailing edge, and a pressure side and a suction side extending from the leading edge to the trailing edge and defining an airfoil cavity therein; a squealer tip arranged at the airfoil tip and comprising a trailing edge tip portion disposed at the trailing edge of the airfoil and a pressure side rail and a suction side rail meeting at the trailing edge tip portion and defining a squealer tip pocket at the airfoil tip; and at least one tip cooling hole disposed at the squealer tip pocket to provide cooling air from the airfoil cavity to the squealer tip pocket, wherein the trailing edge tip portion of the squealer tip may include: a chamfer disposed towards the pressure side of the airfoil; and a groove extending from the squealer tip pocket to the chamfer to provide cooling air from the squealer tip pocket to the chamfer.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
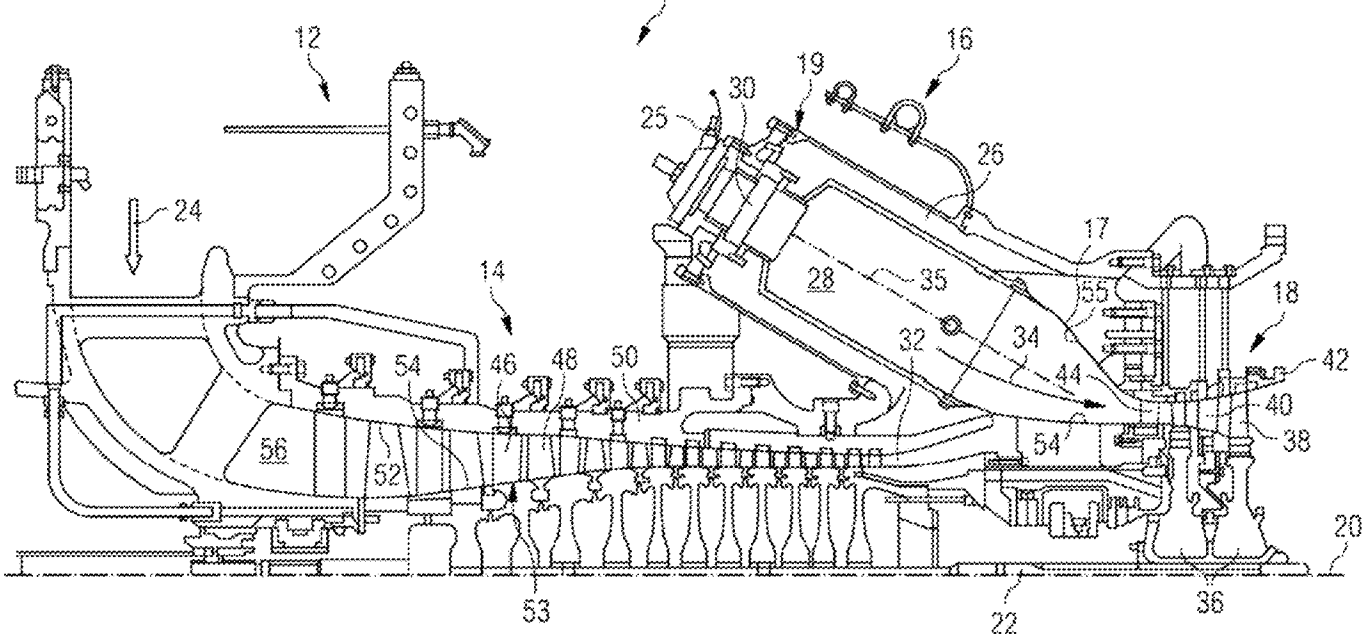
FIG. 1 is a sectional view of a part of a gas turbine including a turbine blade according to an exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Hereinafter, exemplary embodiments will be described below in detail with reference to the accompanying drawings. It should be noted that like reference numerals refer to like parts throughout the various figures and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

FIG. 1 is a sectional view of a part of a gas turbine 10 including a turbine blade according to an exemplary embodiment. Referring to FIG. 1, the gas turbine 10 may include an inlet 12, a compressor section 14, a combustion section 16 and a turbine section 18 arranged in the direction of a rotational axis 20. The gas turbine 10 may further include a shaft 22 rotatable about the rotational axis 20 and extending in a longitudinal direction. The shaft 22 may connect the turbine section 18 to the compressor section 14.

The compressor section 14 may suck air 24 through the air inlet 12, compress the air, and supply the compressed air to the combustion section 16. The combustion section 16 may include a burner plenum 26, one or more combustion chambers 28 and at least one burner 30 fixed to each combustion chamber 28. The combustion chambers 28 and the burners 30 may be located inside the burner plenum 26. The compressed air passing through the compressor section 14 may enter a diffuser 32 and exit the burner plenum 26, where a portion of the air may enter the burner 30 and mix with a gas or liquid fuel. The air/fuel mixture is burned and combustion gas 34 discharged from the combustion section 16 is supplied to the turbine section 18 via a transition duct 17.

A plurality of combustors constituting the combustion section 16 may be arranged in a form of a shell in a housing. Each of the combustors may include the burner 30 having a fuel injection nozzle and the like, a combustor liner defining the combustion chamber 28, and the transition duct 17 serving as a connector between the combustion section 16 and the turbine section 18.

The turbine section 18 may include a plurality of blade carrying disks 36 attached to the shaft 22. FIG. 1 shows two disks 36 each carrying an annular array of turbine blades 38, and it is understood that more or less than two disks may be included in one or more other embodiments. In addition, turbine vanes 40, 44 fixed to a stator 42 of the gas turbine 10 may be disposed between the turbine blades 38 to guide a flow direction of the combustion gas passing through the turbine blades 38.

The combustion gas discharged from the combustion chamber 28 is supplied to the turbine section 18. The supplied combustion gas expands and applies impingement or reaction force to turbine blades 38 to generate rotational torque. That is, the supplied combustion gas drives the turbine blades 38 which in turn rotates the shaft 22. A portion of the rotational torque is transmitted to the compressor section 14, and remaining portion which is the excessive torque is used to drive a generator or the like.

The compressor section 14 may be driven by some of power output from the turbine section 18. The compressor section 14 may include an axial series of vane stages 46 and rotor blade stages 48. The rotor blade stages 48 may include a rotor disc supporting an annular array of blades. The compressor section 14 may further include a casing 50 that surrounds the rotor stages and supports the vane stages 48. The vane stages 46 may include an annular array of radially extending compressor vanes mounted to the casing 50 in such a way that the compressor vanes form each stage. The compressor vanes guide the compressed air transferred from compressor blade disposed at a preceding stage, to compressor blade disposed at a following stage. In an exemplary embodiment, at least some of the compressor vanes may be mounted so as to be rotatable within a predetermined range, e.g., to adjust the inflow rate of air. The casing 50 may define a radially outer surface 52 of a passage 56 of the compressor section 14. A radially inner surface 54 of the passage 56 may be defined at least in part by a rotor drum 53 of the rotor which may be defined in part by the annular array of blades 48.

The exemplary embodiment shows gas turbine having a single shaft connecting single/multi-stage compressor and single/one or more stage turbine, and it is understood that two or three shaft engines may be included in one or more other embodiments.

The terms upstream and downstream refer to the flow direction of the airflow and/or working gas flow through the engine. The terms forward and rearward refer to the flow direction of hot gas through the engine. The terms axial, radial and circumferential are made with reference to the rotational axis 20 of the gas turbine 10.

Figure 2:
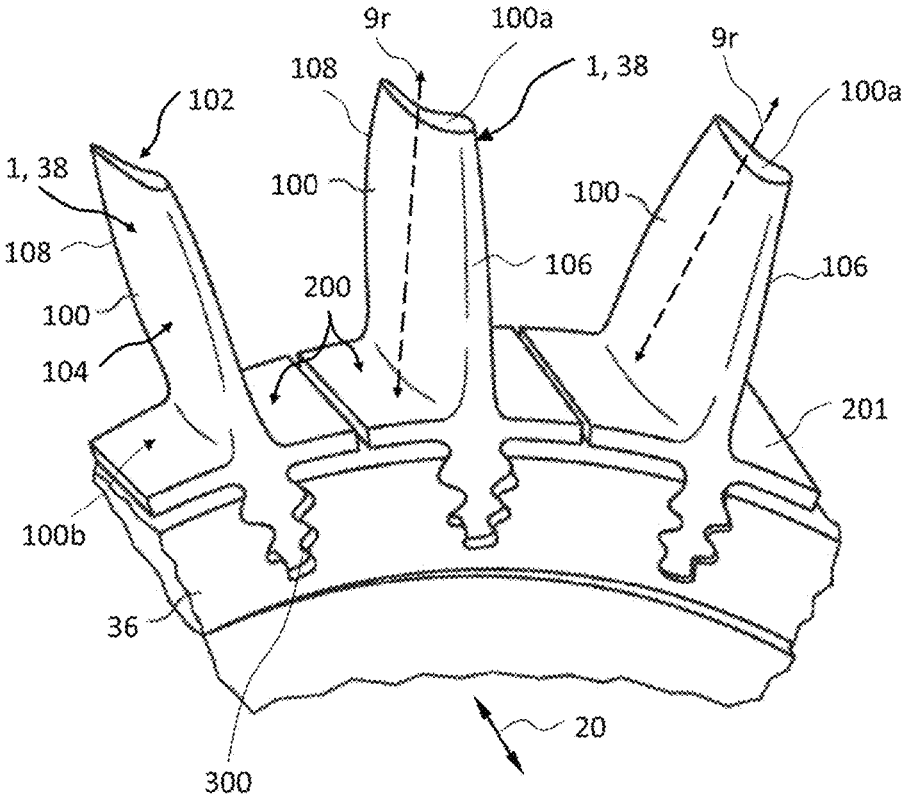
FIG. 2 is a schematical view illustrating a turbine blade assembly according to an exemplary embodiment.
Figure 3:
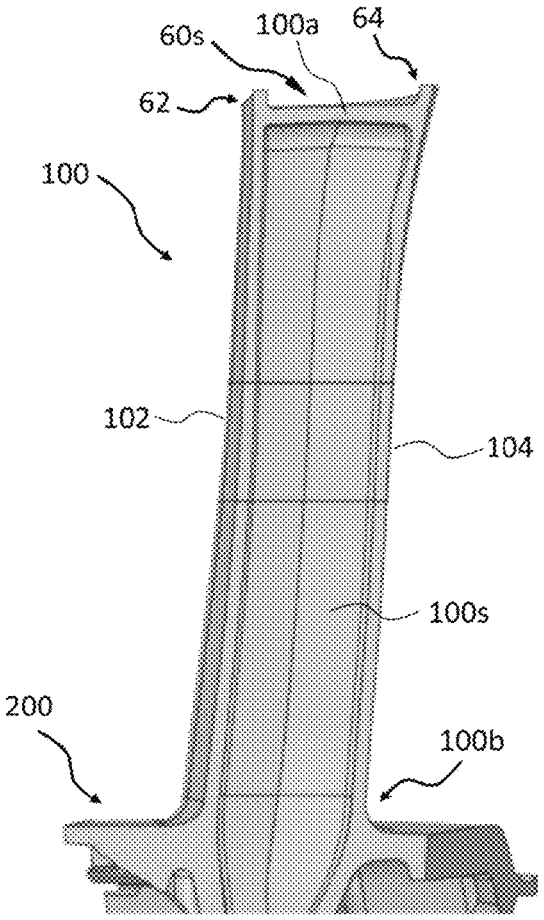
FIG. 3 is a vertical cross-sectional view illustrating a turbine blade according to an exemplary embodiment.
Figure 4:
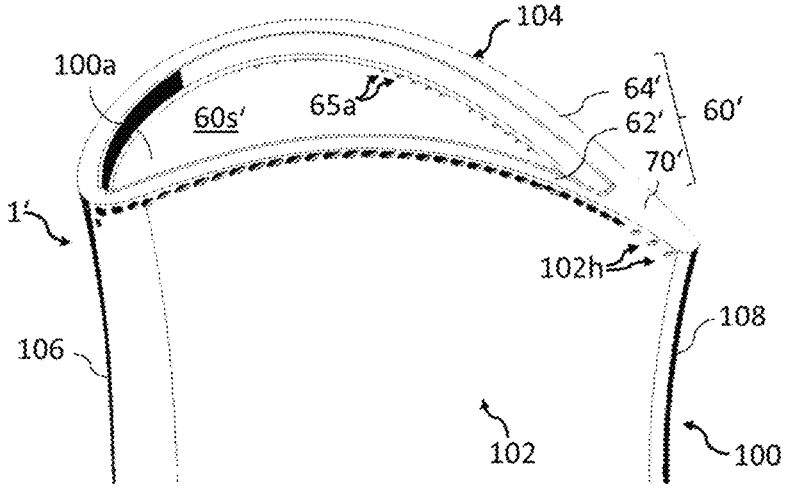
FIG. 4 (PRIOR ART)
FIG. 4 is a perspective view illustrating a part of a related art airfoil with a squealer tip.
Figure 5:
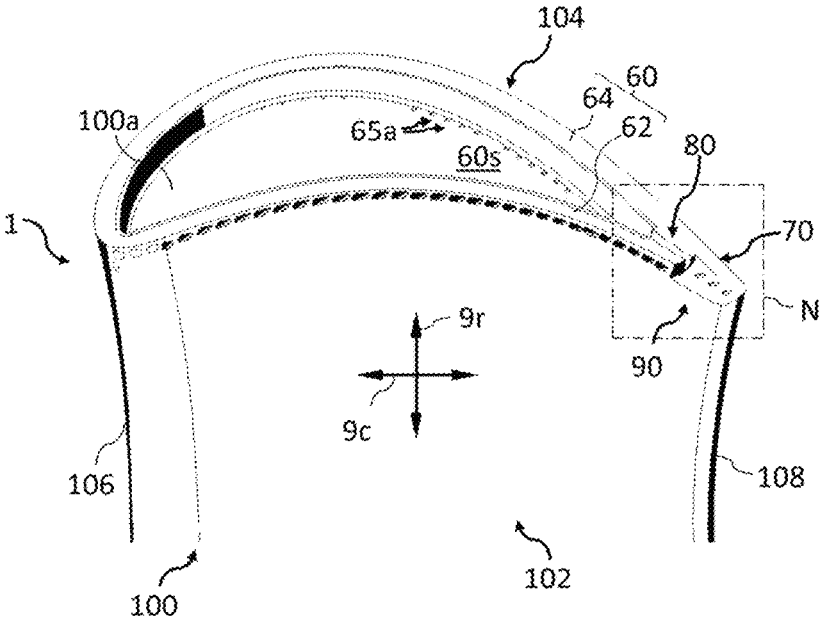
FIG. 5 is a perspective view illustrating a part of an airfoil of a blade according to an exemplary embodiment.
Figure 6:
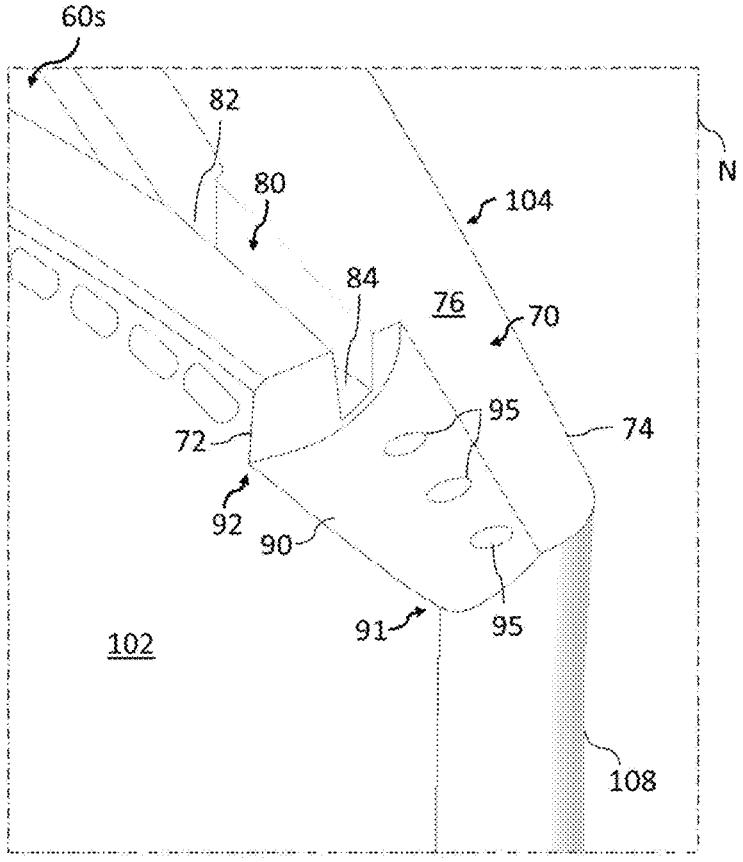
FIG. 6 is a perspective view of a portion N of FIG. 5.
Figure 7:
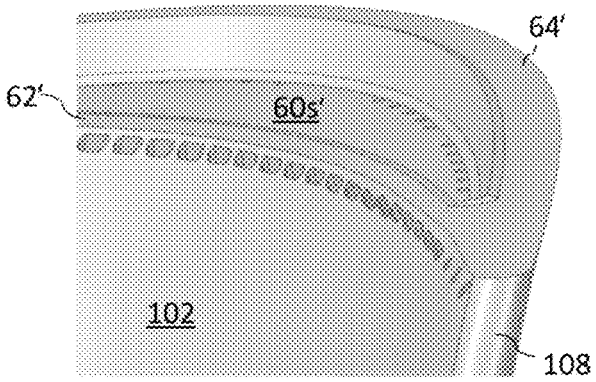
FIG. 7 (PRIOR ART)
FIG. 7 is another perspective view illustrating a part of the related art airfoil with the squealer tip of FIG. 4.
Figure 8:
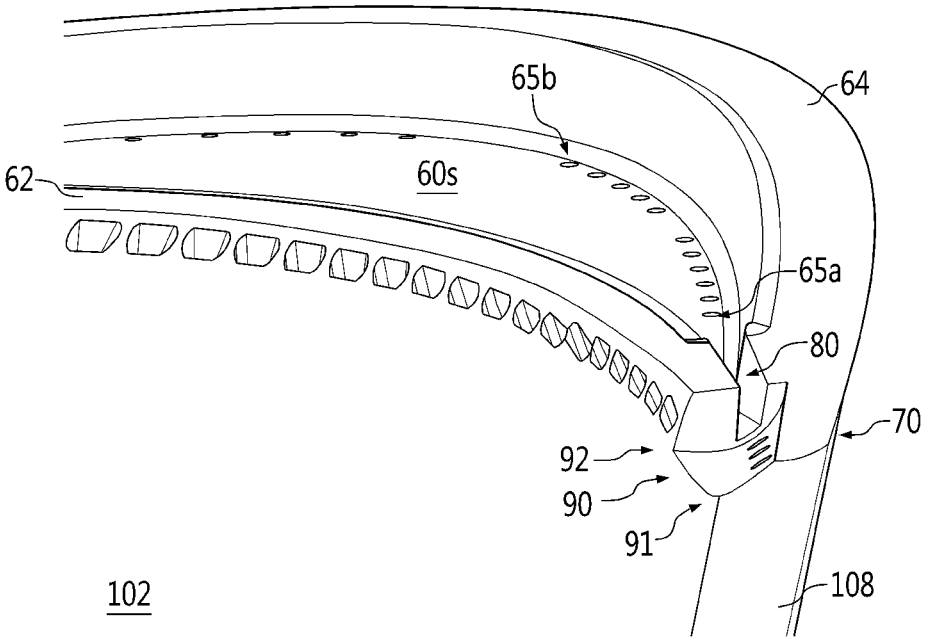
FIG. 8 is another perspective view illustrating a part of the airfoil of the blade of FIG. 5.

FIG. 2 is a schematical view illustrating a turbine blade assembly according to an exemplary embodiment. FIG. 3 is a vertical cross-sectional view illustrating a turbine blade according to an exemplary embodiment. FIG. 5 is a perspective view illustrating a part of an airfoil of a turbine blade according to an exemplary embodiment. FIG. 6 is a perspective view of a portion N of FIG. 5. FIG. 8 is another perspective view illustrating a part of the airfoil of the blade of FIG. 5.

Referring to FIGS. 2 and 3, the turbine blade assembly may include the turbine blades 38, also referred to as turbine blade 1, arranged on and coupled to the rotor disk 36. The turbine blade 1 may include a platform 200, an airfoil 100 extending radially outwardly from the platform 200 which may extend circumferentially, and a root 300 extending radially inwardly from the platform 200. The turbine blade 1 may be fixed to the rotor disk 36 via the root 300. The airfoil 100 may be formed of an airfoil-shaped curved plate and have an optimized shape according to specification of the gas turbine 10.

Referring to FIGS. 2, 3, 5, 6 and 8, the airfoil 100 includes a pressure side 102 (also referred to as pressure surface or concave surface/side) and a suction side 104 (also referred to as suction surface or convex surface/side). The pressure side 102 and the suction side 104 meet at a leading edge 106 and a trailing edge 108 of the airfoil 100.

The airfoil 100 may have a base part **100*b* adjacent to the platform 200 and a tip part 100*a* (also referred to as an airfoil tip) spaced apart from the base part 100*b* along a radial direction 9*r* of the airfoil 100**.

The pressure side 102, the suction side 104, the leading edge 106 and the trailing edge 108 define an airfoil cavity **100*s* of the airfoil 100. The airfoil cavity 100*s* of the airfoil 100 may be limited by a wall of the airfoil tip 100*a* disposed at the radially outermost end of the airfoil 100**.

The airfoil tip **100*a*** may be formed as a wall having an outer surface and an inner surface.

The turbine blade 1 includes a squealer tip 60. The squealer tip 60 may be disposed at the airfoil tip **100*a*, e.g., may extend outward radially from the outer surface of the airfoil tip 100*a***.

Referring to FIGS. 5, 6 and 8, the squealer tip 60 may be formed as a rail that surrounds continuously or intermittently along a periphery of the airfoil tip **100*a***.

The squealer tip 60 may include a suction side rail 64 positioned at and extending along a periphery of the suction side 104 at the airfoil tip **100*a*, a pressure side rail 62 positioned at and extending along a periphery of the pressure side 102 at the airfoil tip 100*a*, and a trailing edge tip portion 70 disposed at the trailing edge 108 of the airfoil 100**.

The pressure side rail 62 and the suction side rail 64 meet at the trailing edge tip portion 70. The trailing edge tip portion 70 may be formed as a unitary rail which spans between the pressure side 102, the suction side 104 and the trailing edge 108. The trailing edge tip portion 70 does not extend to the leading edge 106 of the airfoil 100.

The pressure side rail 62, the suction side rail 64, the trailing edge tip portion 70 and the airfoil tip 100*a* define a squealer tip pocket 60*s* disposed at the airfoil tip 100*a* in a radially outward direction.

A plurality of airfoil tip cooling holes 65*a*, 65*b* may be disposed in the squealer tip pocket 60*s* to conduct a flow of cooling air from the airfoil cavity 100*s* to the squealer tip pocket 60*s*.

An outlet of the airfoil tip cooling holes 65*a*, 65*b* may be positioned at the airfoil tip 100*a* within the squealer tip pocket 60*s*, and an inlet of the airfoil tip cooling holes 65*a*, 65*b* may be positioned at the airfoil cavity 100*s*.

The trailing edge tip portion 70 includes a chamfer 90 and a groove 80. The chamfer 90 is arranged towards the pressure side 102 of the airfoil 100. The groove 80 extends between the chamfer 90 and the squealer tip pocket 60*s*. At least a part of the cooling air from the squealer tip pocket 60*s* flows to the chamfer 90 via the groove 80.

An inlet 82 of the groove 80 may be positioned at the squealer tip pocket 60*s* to receive cooling air from the squealer tip pocket 60*s*. An outlet 84 of the groove 80 may be positioned at or adjacent to the chamfer 90 to allow cooling air from the outlet 84 to flow to the chamfer 90.

The trailing edge tip portion 70 may include a pressure-side surface 72 corresponding to the pressure side 102 of the airfoil 100, a suction-side surface 74 corresponding to the suction side 104 of the airfoil 100, a side surface facing the squealer tip pocket 60*s* and extending between the pressure rail 62 and the suction rail 64, and an upper surface 76 which is a radially outer surface of the trailing edge tip portion 70.

Here, the chamfer 90 is disposed between the upper surface 76 and the pressure side surface 72 of the trailing edge tip portion 70 or between the upper surface 76 and the pressure side 102 of the airfoil 100.

The groove 80 is formed as a flow channel for cooling air from the squealer tip pocket 60*s* to the chamfer 90, for example, is formed as an indentation or cavity or recess or notch formed in the trailing edge tip portion 70. For example, the groove 80 may be formed in a radially inward direction with respect to axis 9*r* of the airfoil 100 in the radially upper surface 76 of the trailing edge tip portion 70.

The groove 80 may extend in a longitudinal direction along a camber line of the airfoil 100. That is, a shape of the groove 80 may be aligned with or corresponding to the camber line of the airfoil 100. The chamfer 90 may extend in the longitudinal direction along the camber line of the airfoil 100. That is, a shape of the chamfer 90 may be aligned with or corresponding to the camber line of the airfoil 100. However, it is understood that the shapes are not limited to examples described above and may be changed or vary according to one or more other exemplary embodiments.

For example, the groove 80 may be disposed between the squealer tip pocket 60*s* and the chamfer 90 along a chordwise direction 9*c* of the airfoil 100.

As shown in FIG. 6, the chamfer 90 may include a first portion disposed adjacent to the trailing edge 108 of the airfoil 100. The first portion may be a position or portion of the chamfer 90 where the chamfer 90 starts at or adjacent the trailing edge 108 of the airfoil 100. The first portion may be referred to as a trailing-edge-side 91 of the chamfer 90.

The chamfer 90 may further include a second portion disposed adjacent to the groove 80. The second portion may be a position or portion of the chamfer 90 where the chamfer 90 starts at or adjacent the groove 80. The second portion may be referred to as a groove-side 92 of the chamfer 90. The groove-side 92 of the chamfer 90 faces the trailing-edge-side 91 of the chamfer 90 in the chordwise direction 9*c* of the airfoil 100. Another embodiment regarding the shape of the chamfer 90 is described with reference to FIGS. 8 and 9A to 9C.

Along the chordwise direction 9*c* of the airfoil 100, when moving from the leading edge 106 to the trailing edge 108 of the airfoil 100, the squealer tip pocket 60*s*, the groove 80 and the chamfer 90 may be arranged consecutively or sequentially.

Figure 9A:
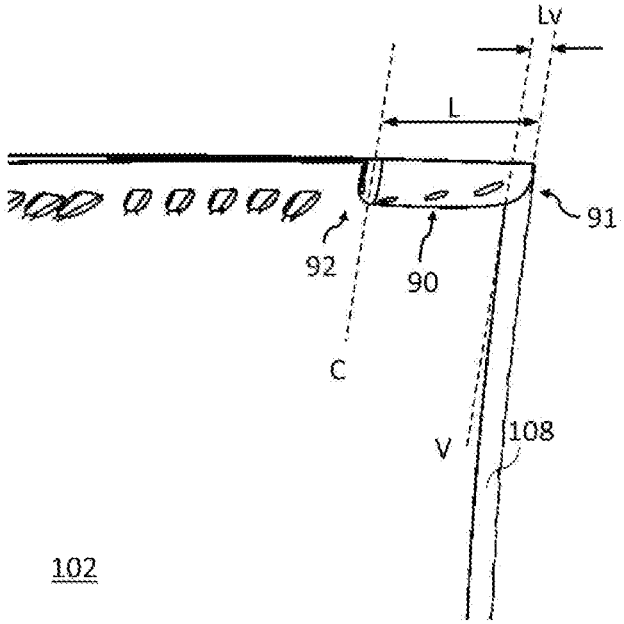
FIG. 9A is a schematical view illustrating a chamfer of a trailing edge tip portion of the blade according to an exemplary embodiment.
Figure 9B:
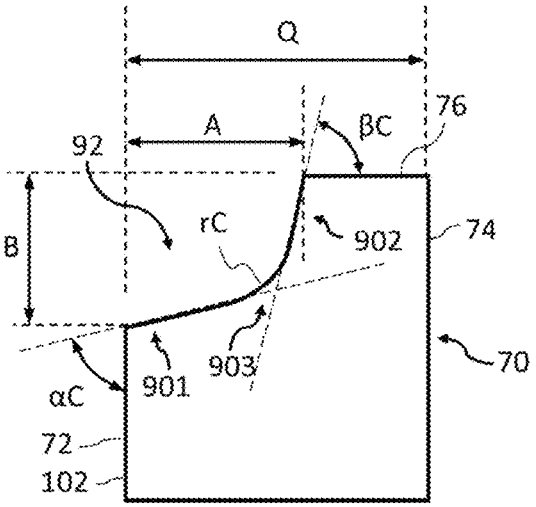
FIG. 9B is a schematical cross-sectional view of the chamfer of the trailing edge tip portion along the line C of FIG. 9A.
Figure 9C:
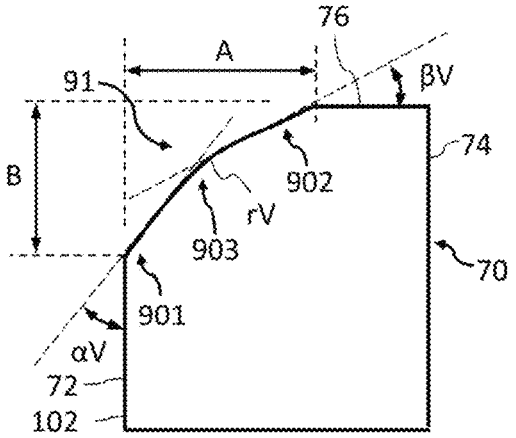
FIG. 9C is a schematical cross-sectional view of the chamfer of the trailing edge tip portion along the line V of FIG. 9A.

Hereinafter, another exemplary embodiments regarding the shape of the chamfer 90 are described with reference to FIG. 8 and FIGS. 9A to 9C. FIG. 9A is a schematical view illustrating a chamfer of a trailing edge tip portion of the blade according to an exemplary embodiment. FIG. 9B is a schematical cross-sectional view of the chamfer of the trailing edge tip portion (i.e., the groove-side 92) along the line C of FIG. 9A, when viewed in the chordwise direction 9*c* from the leading edge 106 towards the trailing edge 108 of the airfoil 100. FIG. 9C is a schematical cross-sectional view of the chamfer of the trailing edge tip portion (i.e., the trailing-edge-side 91) along the line V of FIG. 9A, when viewed in the chordwise direction 9*c* from the trailing edge 108 towards the leading edge 106 of the airfoil 100.

Referring to FIGS. 8 and 9B, the chamfer 90 may be concave at the groove-side 92 of the chamfer 90. For example, entire chamfer 90, that is, from the groove-side 92 to the trailing-edge-side 91, may have a concave shape.

Referring to FIGS. 8 and 9C, the chamfer 90 may be convexly shaped at the trailing-edge-side 91 of the chamfer 90. For example, entire chamfer 90, that is, from the groove-side 92 to the trailing-edge-side 91, may have a convex shape.

Alternatively, the chamfer may be planar in shape at the trailing-edge-side 91 of the chamfer 90. For example, entire chamfer 90, that is, from the groove-side 92 to the trailing-edge-side 91, may have a planar shape.

Referring to FIG. 8 and FIGS. 9A to 9C, the chamfer 90 may be concave at the groove-side 92 of the chamfer 90 and may be planar or convex at the trailing-edge-side 91 of the chamfer 90. Also, the shape of the chamfer 90 may be formed by gradually transitioning from the concave shape at the groove-side 92 to the planar shape or the convex shape at the trailing-edge-side 91 of the chamfer 90.

Referring to FIG. 9A, a length L of the chamfer 90 may be greater than or equal to 0.01 times a chord length of the airfoil 100, and may be less than or equal to 0.2 times the chord length of the airfoil 100. Preferably, the length L of the chamfer 90 may be greater than or equal to 0.02 times the chord length of the airfoil 100 and less than or equal to 0.15 times the chord length of the airfoil 100.

The chamfer 90 may be defined between a first position of the trailing edge tip portion 70 and a second position of the trailing edge tip portion 70 of the squealer tip 60.

The position at line V in FIG. 9A may be the first position of the trailing edge tip portion 70. For example, the first position may radially overlap the trailing edge 108 of the airfoil 100 as shown in FIG. 8. Alternatively, as shown in FIG. 9A, the first position may be spaced apart from the trailing edge 108 of the airfoil 100 by a distance Lv in the chordwise direction. The distance Lv may be less than or equal to 0.1 times the length L of the chamfer 90 measured along the chordwise direction from the trailing edge 108 of the airfoil 100. The part of the chamfer 90 disposed at the first position is the trailing-edge-side 91 of the chamfer 90.

The position at line C in FIG. 9A may be the second position of the trailing edge tip portion 70. The second position may correspond to a distance equal to or less than 0.2 times the chord length of the airfoil 100 from the first position measured along a chord of the airfoil 100. The part of the chamfer 90 disposed at the second position is the groove-side 92 of the chamfer 90.

Referring to FIGS. 9B and 9C, the chamfer 90 may include a first planar portion 901, a second planar portion 902 and an intermediate fillet portion 903 between the first and second planar portions 901, 902, i.e., an arc shaped portion connecting the first and second planar portions 901, 902. The first planar portion 901, the fillet portion 903 and the second planar portion 902 may be arranged along the radial direction 9*r* of the airfoil 100. In other words, the fillet portion 903 may be disposed radially outward with respect to the radial direction 9*r* of the first planar portion 901, and the second planar portion 902 may be disposed radially outward with respect to the radial direction 9*r* of the fillet portion 903. The shape including the first planar portion 901, the fillet portion 903 and the second planar portion 902 is easy to manufacture with precision.

In FIGS. 9B and 9C, reference sign 'A' indicates a maximum width of the chamfer 90, reference sign 'B' indicates a maximum height/depth of the chamfer 90, and reference sign 'Q' indicates a maximum width of the trailing edge tip portion 70 at the groove-side 92. The widths A and Q are measured along a thickness direction of the airfoil 100, i.e., a direction extending vertically between the pressure side 102 and the suction side 104 of the airfoil 100. In other words, the widths A and Q are measured perpendicular to each other with respect to directions 9*r* and 9*c*. The height or depth B is measured along the radial direction 9*r* of the airfoil 100.

The width Q of the trailing edge tip portion 70 at the groove-side 92 may be greater than or equal to 0.02 times the chord length, and less than or equal to 0.1 times the chord length.

For example, the width A of the chamfer 90, i.e., at the groove-side 92 or at the trailing-edge-side 91 of the chamfer 90 between the groove-side 92 and the trailing-edge-side 91 of the chamfer 90, may be greater than or equal to 0.2 times the width Q of trailing edge tip portion 70 at the groove-side 92.

Here, a ratio (i.e., a ratio B/A) of the height/depth B and the width A of the chamfer 90, i.e., at the groove-side 92 or at the trailing-edge-side 91 of the chamfer 90 between the groove-side 92 and the trailing-edge-side 91 of the chamfer 90, may be greater than or equal to 0.5, and less than or equal to 2.

The width A and/or height/depth B of the chamfer 90 may be constant, i.e., may be same from the groove-side 92 to the trailing-edge-side 91 of the chamfer 90.

Here, the ratio B/A may be constant from the groove-side to the trailing-edge-side. For example, one or both of width W and height B may remain the same or vary, but the ratio B/A may be constant from the groove-side to the trailing-edge-side.

In FIGS. 9B and 9C, reference sign 'rC' indicates a maximum radius of the fillet portion 903 at groove-side 92 of chamfer 90, and reference sign 'rV' indicates a maximum radius of the fillet portion 903 at trailing-edge-side 91 of chamfer 90.

For example, the radius of the fillet portion 903 of the chamfer 90, i.e., radius rC at the groove-side 92 or radius rV at the trailing-edge-side 91 of the chamfer 90 between the groove-side 92 and the trailing-edge-side 91 of the chamfer 90, may be greater than or equal to 0.005 times the chord length of the airfoil 100, and preferably may be greater than or equal to 0.01 times the chord length of the airfoil 100.

In FIG. 9B, reference sign 'αC' indicates an angle between the first planar surface 901 of the chamfer 90 and the airfoil pressure side 102 and/or the pressure-side surface 72 of the trailing edge tip portion 70 at the groove-side 92 of the chamfer 90, and reference sign 'βC' indicates an angle between the second planar surface 902 of the chamfer 90 and the upper surface 76 of the trailing edge tip portion 70 at the groove-side 92 of the chamfer 90.

For example, the angles αC and βC may be greater than or equal to 10° and less than or equal to 85°. Preferably, the angles αC and βC may be greater than or equal to 45° and less than or equal to 85°.

In FIG. 9C, reference sign 'αV' indicates an angle between the first planar surface 901 of the chamfer 90 and the airfoil pressure side 102 and/or the pressure-side surface 72 of the trailing edge tip portion 70 at the trailing-edge-side 91 of the chamfer 90, and reference sign 'βV' indicates an angle between the second planar surface 902 of the chamfer 90 and the upper surface 76 of the trailing edge tip portion 70 at the trailing-edge-side 91 of the chamfer 90.

For example, the angles αV and βW may be greater than or equal to 5° and less than or equal to 85°. Preferably, the angles αV and βW may be greater than or equal 10° and less than or equal to 60°, more preferably the angles αV and βW may be greater than or equal 10° and less than or equal to 45°.

Here, the angles α and β, i.e., at any position of the chamfer 90 between the groove-side 92 and the trailing-edge-side 91, may be equal to or less than the angle αC, βC at the groove-side 92 of the airfoil 100, and may be equal to or greater than the angle αV, βV at the trailing-edge-side 91 of the airfoil 100.

As shown in FIGS. 5, 6 and 8, the trailing edge tip portion 70 may include at least one chamfer-cooling hole 95 disposed at the chamfer 90. The chamfer cooling holes 95 provide cooling air from the airfoil cavity 100*s* to the chamfer 90. FIG. 6 shows three chamfer-cooling holes 95, and it is understood that more or less than 3 chamfer-cooling holes 95 may be included in one or more other embodiments.

The trailing edge tip portion 70 may include a plurality of chamfer-cooling holes 95 spaced apart from each other. The chamfer-cooling holes 95 may be arranged at equal intervals along the chordwise direction 9*c* of the airfoil 100 or along the camber line of the airfoil 100.

Referring to FIG. 6, the outlet 84 of the groove 80 may be spaced apart from the chamfer 90 along a spanwise direction or radial direction 9*r*, i.e., a floor 88 (shown in FIGS. 11A-12B) may be disposed radially outward of the chamfer 90.

Figure 10:
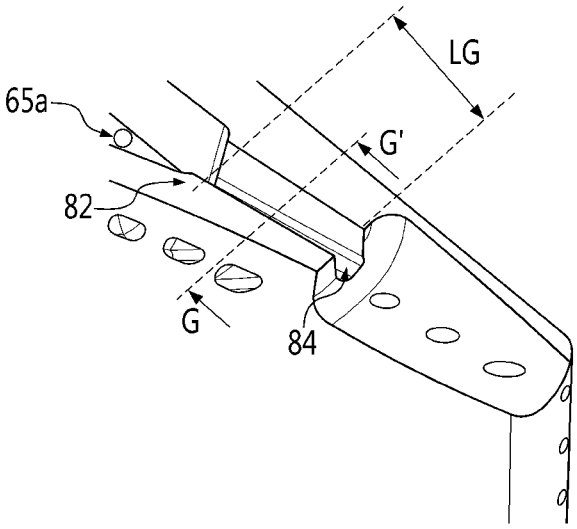
FIG. 10 is a schematical illustration of a groove of a trailing edge tip portion of the blade according to an exemplary embodiment.
Figure 11A:
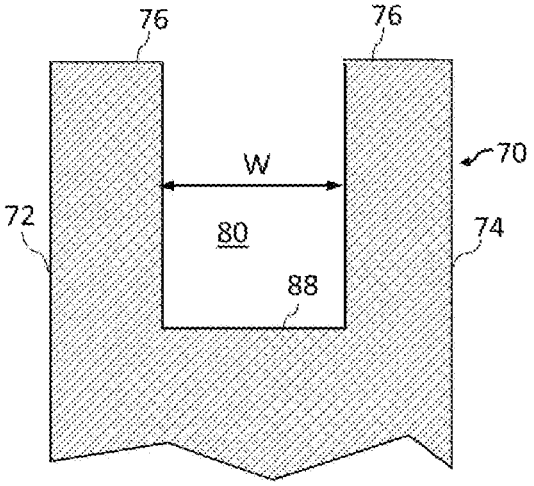
FIG. 11A is a schematical cross-sectional view illustrating the groove of the trailing edge tip portion along the line G-G' of FIG. 10.
Figure 11B:
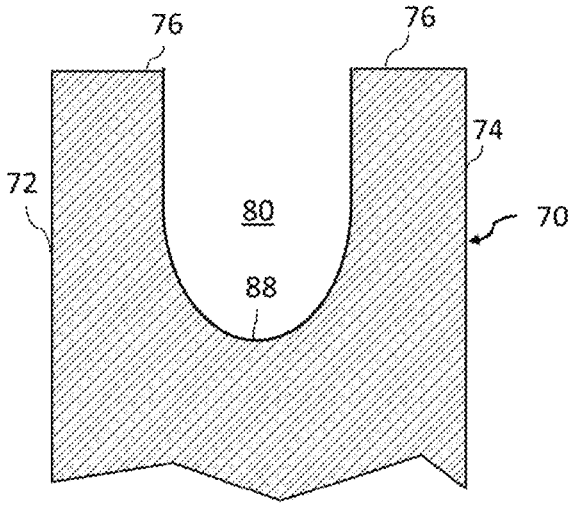
FIG. 11B is a schematical cross-sectional view illustrating the groove of the trailing edge tip portion along the line G-G' of FIG. 10 according to another exemplary embodiment.
Figure 12A:
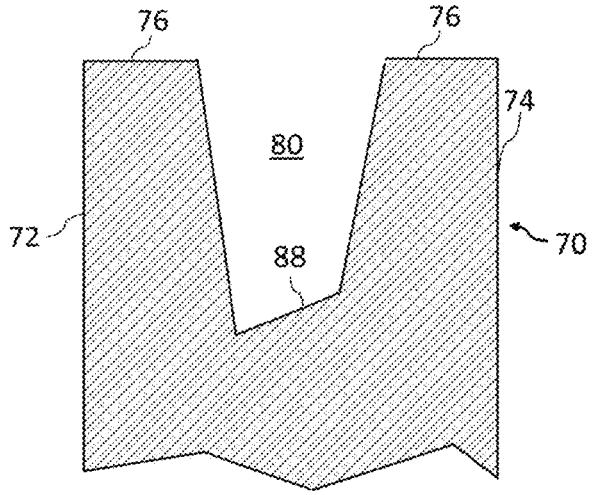
FIG. 12A is a schematical cross-sectional view illustrating the groove of the trailing edge tip portion along the line G-G' of FIG. 10 according to another exemplary embodiment.
Figure 12B:
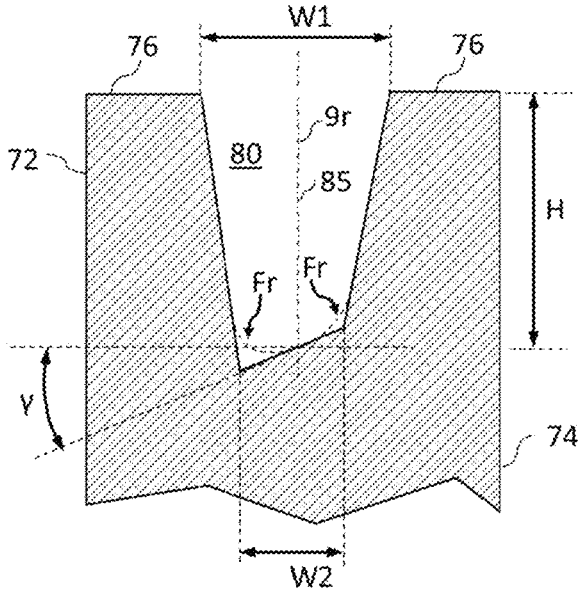
FIG. 12B is a schematical view illustrating the groove of FIG. 12A.

Hereinafter, another exemplary embodiments regarding the shape of the groove 80 are described with reference to FIGS. 10 to 12B. FIG. 10 is a schematical illustration of a groove of a trailing edge tip portion of the blade according to an exemplary embodiment. FIG. 11A is a schematical cross-sectional view illustrating the groove of the trailing edge tip portion along the line G-G' of FIG. 10, when viewed in the chordwise direction 9*c* from the trailing edge 108 towards the leading edge 106 of the airfoil 100. FIG. 11B is a schematical cross-sectional view illustrating the groove of the trailing edge tip portion along the line G-G' of FIG. 10 according to another exemplary embodiment. FIG. 12A is a schematical cross-sectional view illustrating the groove of the trailing edge tip portion along the line G-G' of FIG. 10 according to another exemplary embodiment. FIG. 12B is a schematical view illustrating the groove of FIG. 12A.

Referring to FIG. 10, the at least one tip cooling hole 65*a*, 65*b* may include a first tip cooling hole 65*a* disposed adjacent to the inlet 82 of the groove 80. The first cooling hole 65*a* may be positioned from the inlet 82 of the groove 80 within a distance equal to a length LG of the groove 80 measured along chordwise direction 9*c* from the inlet 82 of the groove 80. Preferably, the first cooling hole 65*a* may be disposed from the inlet 82 of the groove 84 within a distance equal to half the length LG of the groove 80.

Referring to FIGS. 11A to 12B, the groove 80 may include side walls facing each other and a floor 88 forming a bottom surface of the groove 80. The floor 88 may be planar or may be curved or rounded. The planar floor 88 may be disposed horizontally, i.e., along the thickness direction of the airfoil 100. Alternatively, the planar floor 88 may be inclined with respect to the pressure side 102 or the pressure-side surface 72. Preferably, the planar floor 88 may be inclined downward towards the pressure side 102 or the pressure-side surface 72.

As shown in FIG. 11A, the groove 80 may be formed such that a width W of the groove 80, i.e., a spacing between the opposite side walls, may be constant or unchanged along a spanwise direction of the airfoil 100 i.e., the radially inward direction 9*r* of the airfoil 100. This ensures increased volume or amount of cooling air to flow to the chamfer 90.

Alternatively, as shown in FIGS. 11B, 12A and 12B, the groove 80 may be formed such that a width W of the groove 80, i.e., a spacing between the opposite side walls, may decrease along a spanwise direction of the airfoil 100 i.e., the radially inward direction 9*r* of the airfoil 100. For example, a width W1 at an opening of the groove 80 formed at the upper surface 76 may be greater than a width W2 at the floor 88 of the groove 80.

As shown in FIG. 10, the length LG of the groove 80 may be greater than or equal to 0.01 times the chord length of the airfoil 100, and may be less than or equal to 0.20 times the chord length of the airfoil 100. Preferably, the length LG of the groove 80 may be greater than or equal to 0.02 times the chord length of the airfoil 100 and less than or equal to 0.15 times the chord length of the airfoil 100.

In FIG. 12B, reference sign 'H' denotes a height or depth of the groove 80 measured along the radial direction 9*r* of the airfoil 100 from the upper surface 76 of the trailing edge tip portion 70 of the squealer tip 60.

A maximum width W1 of the groove 80, i.e., width W1 at the opening of the groove 80 formed at the upper surface 76, may be less than or equal to the maximum width A of the chamfer 90.

The maximum width W1 of the groove 80 may be greater than or equal to 0.5 mm, and may be less than or equal to the maximum width A of the chamfer 90.

A maximum depth/height H of the groove 80 may be less than or equal to the maximum depth/height B of the chamfer 90.

The maximum depth/height H of the groove 80 may be greater than or equal to 0.5 mm, and may be less than or equal to the maximum depth/height B of the chamfer 90.

The depth/height H of the groove 80 may be constant from the inlet 82 to the outlet 84 of the groove 80. If the floor 88 is inclined or the floor 88 is non-planar or curved, the depth/height H of the groove 80 may be a mean depth/height H of the groove 80.

In FIG. 12B, reference sign 'γ' denotes an inclination angle of the floor 88 of the groove 80 with respect to the thickness direction of the airfoil 100.

The angle γ may be greater than or equal to 0° and less than or equal to 75°. The angle γ of the floor 88 of the groove 80 may be constant from the inlet 82 to the outlet 84 of the groove 80.

The side walls and the floor 88 of the groove 80 may be filleted, i.e., may be connected by an arc-shaped edge as shown by dashed line Fr in FIG. 12B.

A radius of the filleted part between the side walls and the floor 88 of the groove 80 may be greater than or equal to 0.1 mm and less than or equal to half of W2, i.e., a minimum width W2 of the groove 80 or a width W2 at the floor 88 of the groove 80.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims. Accordingly, the description of the exemplary embodiments should be construed in a descriptive sense only and not to limit the scope of the claims, and many alternatives, modifications, and variations will be apparent to those skilled in the art.

What is claimed is:

1. A turbine blade comprising:

an airfoil having an airfoil tip, a leading edge, a trailing edge, and a pressure side and a suction side extending from the leading edge to the trailing edge and defining an airfoil cavity therein;

a squealer tip arranged at the airfoil tip and comprising a trailing edge tip portion disposed at the trailing edge of the airfoil and a pressure side rail and a suction side rail defining a squealer tip pocket at the airfoil tip; and at least one tip cooling hole disposed at the squealer tip pocket to provide cooling air from the airfoil cavity to the squealer tip pocket, wherein the trailing edge tip portion of the squealer tip comprises:

an upper surface which is a radially outer surface of the trailing edge tip portion;

a pressure side surface corresponding to the pressure side of the airfoil;

a chamfer disposed between and obliquely formed by connecting the upper surface of the trailing edge tip portion and the pressure side surface of the trailing edge tip portion; and a groove extending from the squealer tip pocket to the chamfer to provide cooling air from the squealer tip pocket to the chamfer, wherein the chamfer has a concave shape at a groove-side of the chamfer; and wherein the chamfer has a planar or convex shape at a trailing-edge-side of the chamfer.

2. The turbine blade according to claim 1, wherein the groove and the chamfer extend in a longitudinal direction along a camber line of the airfoil.

3. The turbine blade according to claim 1, wherein a shape of the chamfer is gradually changing from the groove-side of the chamfer to the trailing-edge-side of the chamfer by gradually transitioning from the concave shape at the groove-side of the chamfer to the planar or convex shape at the trailing-edge-side of the chamfer.

4. The turbine blade according to claim 1, wherein the trailing edge tip portion comprises at least one chamfer-cooling hole disposed at the chamfer to provide cooling air from the airfoil cavity to the chamfer.

5. The turbine blade according to claim 4, wherein the trailing edge tip portion comprises a plurality of chamfer-cooling holes spaced apart from each other at regular intervals.

6. The turbine blade according to claim 1, wherein an outlet of the groove is spaced apart from the chamfer along a radially outward direction of the airfoil.

7. The turbine blade according to claim 1, the at least one tip cooling hole comprises a first tip cooling hole disposed adjacent to an inlet of the groove.

8. The turbine blade according to claim 1, wherein a length of the chamfer is greater than or equal to 0.01 times a chord length of the airfoil and less than or equal to 0.2 times the chord length of the airfoil.

9. The turbine blade according to claim 1, wherein the chamfer is defined between a first position of the trailing edge tip portion corresponding to the trailing edge of the airfoil and a second position of the trailing edge tip portion corresponding to a distance equal to or less than 0.2 times the chord length of the airfoil from the first position measured along a chord of the airfoil.

10. The turbine blade according to claim 1, wherein a width of the groove decreases along a radially inward direction of the airfoil; and wherein a floor of the groove is inclined downward towards the pressure side of the airfoil.

11. The turbine blade according to claim 1, wherein a length of the groove is greater than or equal to 0.01 times a chord length of the airfoil and less than or equal to 0.2 times the chord length of the airfoil.

12. The turbine blade according to claim 1, wherein a length of the groove is smaller than a length of the chamfer.

13. A turbine blade assembly comprising:

a rotor disk configured to be rotatable; and a plurality of turbine blades installed on the rotor disk, wherein each of the turbine blades comprises:

an airfoil having an airfoil tip, a leading edge, a trailing edge, and a pressure side and a suction side extending from the leading edge to the trailing edge and defining an airfoil cavity therein;

a squealer tip arranged at the airfoil tip and comprising a trailing edge tip portion disposed at the trailing edge of the airfoil and a pressure side rail and a suction side rail defining a squealer tip pocket at the airfoil tip; and at least one tip cooling hole disposed at the squealer tip pocket to provide cooling air from the airfoil cavity to the squealer tip pocket, wherein the trailing edge tip portion of the squealer tip comprises:

an upper surface which is a radially outer surface of the trailing edge tip portion;

a pressure side surface corresponding to the pressure side of the airfoil;

a chamfer disposed between and obliquely formed by connecting the upper surface of the trailing edge tip portion and the pressure side surface of the trailing edge tip portion; and a groove extending from the squealer tip pocket to the chamfer to provide cooling air from the squealer tip pocket to the chamfer, wherein the chamfer has a concave shape at a groove-side of the chamfer; and wherein the chamfer has a planar or convex shape at a trailing-edge-side of the chamfer.

14. The turbine blade assembly according to claim 13, wherein the groove and the chamfer extend in a longitudinal direction along a camber line of the airfoil.

15. The turbine blade assembly according to claim 13, wherein a shape of the chamfer is gradually changing from the groove-side of the chamfer to the trailing-edge-side of the chamfer by gradually transitioning from the concave shape at the groove-side of the chamfer to the planar or convex shape at the trailing-edge-side of the chamfer.

16. The turbine blade assembly according to claim 13, wherein the trailing edge tip portion comprises at least one chamfer-cooling hole disposed at the chamfer to provide cooling air from the airfoil cavity to the chamfer.

17. The turbine blade assembly according to claim 16, wherein the trailing edge tip portion comprises a plurality of chamfer-cooling holes spaced apart from each other at regular intervals.

18. A gas turbine comprising:

a compressor configured to compress air introduced thereinto from an outside;

a combustor configured to mix fuel with air compressed by the compressor for combustion; and a turbine including a plurality of turbine blades rotated by combustion gas produced by the combustor, wherein each of the turbine blades comprises:

an airfoil having an airfoil tip, a leading edge, a trailing edge, and a pressure side and a suction side extending from the leading edge to the trailing edge and defining an airfoil cavity therein;

a squealer tip arranged at the airfoil tip and comprising a trailing edge tip portion disposed at the trailing edge of the airfoil and a pressure side rail and a suction side rail defining a squealer tip pocket at the airfoil tip; and at least one tip cooling hole disposed at the squealer tip pocket to provide cooling air from the airfoil cavity to the squealer tip pocket, wherein the trailing edge tip portion of the squealer tip comprises:

an upper surface which is a radially outer surface of the trailing edge tip portion;

a pressure side surface corresponding to the pressure side of the airfoil;

a chamfer disposed between and obliquely formed by connecting the upper surface of the trailing edge tip portion and the pressure side surface of the trailing edge tip portion; and a groove extending from the squealer tip pocket to the chamfer to provide cooling air from the squealer tip pocket to the chamfer, wherein the chamfer has a concave shape at a groove-side of the chamfer; and wherein the chamfer has a planar or convex shape at a trailing-edge-side of the chamfer.

* * * * *